US006201433B1

(12) United States Patent
Nagatomo

(10) Patent No.: US 6,201,433 B1
(45) Date of Patent: Mar. 13, 2001

(54) SEMICONDUCTOR MEMORY DEVICE HAVING CONSTANT VOLTAGE CIRCUIT

(75) Inventor: Masahiko Nagatomo, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/055,987

(22) Filed: Apr. 7, 1998

(30) Foreign Application Priority Data

Aug. 5, 1997 (JP) ..... 9-210720

(51) Int. Cl.[7] ..... G05F 1/10

(52) U.S. Cl. ..... 327/530; 327/538; 327/543

(58) Field of Search ..... 323/312, 313, 323/315; 327/530, 318, 538, 543, 540, 541, 73, 77, 87

(56) References Cited

U.S. PATENT DOCUMENTS 4,873,458 * 10/1989 Yoshida ..... 327/530
5,362,988 * 11/1994 Hellums ..... 327/530
5,394,037 * 2/1995 Josephson et al. ..... 327/530
5,592,119 * 1/1997 Yoo ..... 327/530
5,869,997 * 2/1999 Tomishima ..... 327/530

* cited by examiner

*Primary Examiner*—Jung Ho Kim
(74) *Attorney, Agent, or Firm*—Jones Volentine, L.L.P.

(57) ABSTRACT

A constant voltage circuit is made up of a first transistor of an N-channel type having a drain connected to a power supply voltage and a source connected to the drain of the respective memory cells, a second transistor of an P-channel type having a source connected to the power supply voltage, a gate connected to a ground, and a drain connected to a gate of the first transistor, and a reference voltage generating circuit turning on and fixing the gate of the first transistor to the predetermined voltage when the power supply voltage is more than a predetermined voltage. Accordingly, the constant voltage circuit can apply a high voltage for the output voltage $V_{mcd}$ to drains of each memory cells even if the power supply voltage $V_{cc}$ is a low voltage and further can achieve the improvement of the access velocity for the data reading operation of the semiconductor memory device.

20 Claims, 14 Drawing Sheets

| Vcc | 0~$V_1$ | $V_1$~$3V_1$ | $3V_1$~ |
|---|---|---|---|
| PT2 | OFF | ON | ON |
| NT3 | OFF | ON | ON |
| NT4~NT6 | OFF | OFF | ON |
| Vmcd | Undefined | Vcc~Vtn | 2Vtn |

FIG.3

Vmcd ① : Vmcd of the Conventional Constant Voltage Circuit
Vmcd ② : Vmcd of the Preferred Embodiment Vmcd ① : Vmcd of the Conventional Constant Voltage Circuit Vmcd ② : Vmcd of the Preferred Embodiment Vmcd ① : Vmcd of the Conventional Constant Voltage Circuit Vmcd ② : Vmcd of the Preferred Embodiment Vmcd ① : Vmcd of the Conventional Constant Voltage Circuit Vmcd ② : Vmcd of the Preferred Embodiment Vmcd ① : Vmcd of the Conventional Constant Voltage Circuit Vmcd ② : Vmcd of the Preferred Embodiment Vmcd ① : Vmcd of the Conventional Constant Voltage Circuit Vmcd ② : Vmcd of the Preferred Embodiment

SEMICONDUCTOR MEMORY DEVICE HAVING CONSTANT VOLTAGE CIRCUIT

BACKGROUND OF THE INVENTION

1. Field of the invention:

The present invention generally relates to a semiconductor memory device having a constant voltage circuit, and more particularly, the present invention relates to an erasable-programmable read-only memory (EPROM) and to a one-time programmable read-only memory (OTPROM).

This application is a counterpart of Japanese application Ser. No. 210720/1997, filed Aug. 5, 1997, the subject matter of which is incorporated herein by reference.

2. Description of the Related Art:

FIG. 2 is a circuit diagram for describing a data reading operation according to a conventional semiconductor memory device.

As shown in FIG. 2, the conventional semiconductor memory device, for example an EPROM or an OTPROM, is made up of a memory array 100 having a plurality of memory cells arranged in a matrix of rows the row select signals $WL_0$~$WL_n$ applied thereto and columns having column select signals $Y_0$~$Y_n$ applied thereto. The device also includes a current detecting amplifier 110 electrically connected with the memory array 100, a constant voltage circuit 120 applying a predetermined potential voltage to drains of the respective memory cells 100, and a differential amplifier 130 for amplifying outputs from the current detecting amplifier 110. The conventional semiconductor memory device uses the current detecting amplifier 110 to determine whether or not a storage charge on each of memory cells 100 is present. The conventional semiconductor memory device employs method in which a difference between currents flowing from the selected memory cells 100 to the current detecting amplifier 110 is used to determined whether or not storage charge in present in the memory cells selected by the row select signals $WL_0$~$WL_n$ and column select signals $Y_0$~$Y_n$.

SUMMARY OF THE INVENTION

An object of the present invention is to provide a semiconductor memory device that can apply a high voltage for the output voltage $V_{mcd}$ to drains of each of memory cells even if the power supply voltage $V_{cc}$ is a low voltage and further can achieve the improvement of the access velocity for the data reading operation of the semiconductor memory device.

According to one aspect of the present invention, for achieving the above object, there is provided a constant voltage circuit comprising a first transistor of a first conductive type having a drain connected a power supply voltage and a source connected the drain of the respective memory cells, a second transistor of a second conductive type having a source connected the power supply voltage, a gate connected a ground, and a drain connected a gate of the first transistor, and a reference voltage generating circuit turning on and fixing the gate of the first transistor to the predetermined voltage when the power supply voltage is more than a predetermined voltage.

According to another aspect of the present invention, for achieving the above object, there is provided a constant voltage circuit comprising a first constant voltage circuit having a first transistor of a first conductive type, a second transistor of a second conductive type, and a third transistor of a first conductive type, the first transistor having a drain connected to a power supply voltage and a source connected to the drain of the respective memory cells, the second transistor having a source connected to the power supply voltage, a gate connected to a ground, and a drain connected to a gate of the first transistor, the third transistor having a source connected to the ground, a gate connected to the source of the first transistor, and a drain connected to the gate of the first transistor, a second constant voltage circuit having a fourth transistor of a first conductive type and a reference voltage generating circuit, the fourth transistor connecting in parallels with the first transistor, and the reference voltage generating circuit controlling the fourth transistor so as to turn on when a power supply voltage is lower than the predetermined reference voltage, and controlling the fourth transistor so as to turn off when the power supply voltage is higher than the predetermined reference voltage.

Accord in goo another aspect of the present invention, for achieving the above object, there is provided a constant voltage circuit comprising a first transistor of a first conductive type having a drain connected to a power supply voltage and a source connected to the drain of the respective memory cells, a second transistor of a second conductive type having a source connected to the power supply voltage, a gate connected to a ground, and a drain connected to a gate of the first transistor, and a third transistor of a first conductive type having a source connected to the ground, a gate connected to the source of the first transistor, and a drain connected to the gate of the first transistor, a fourth transistor of a first conductive type connecting in parallel with the first transistor, and a potential detecting circuit controlling the fourth transistor so as to turn on when a power supply voltage is lower than the predetermined reference voltage, and controlling the fourth transistor so as to turn off when the power supply voltage is higher than the predetermined reference voltage.

According to another aspect of the present invention, for achieving the above object, there is provided a constant voltage circuit comprising a first transistor of a first conductive type having a drain connected to a power supply voltage and a source connected to the drain of the respective memory cells, a second transistor of a second conductive type having a source connected to the power supply voltage, a gate connected to a ground, and a drain connected to a gate of the first transistor, a third transistor of a first conductive type having a source connected to the ground, a gate connected to the source of the first transistor, and a drain connected to the gate of the first transistor, a fourth transistor of a second conductive type connecting in parallel with the second transistor, and a potential detecting circuit controlling the fourth transistor so as to turn on when a power supply voltage is lower than the predetermined reference voltage, and controlling the fourth transistor so as to turn off when the power supply voltage is higher than the predetermined reference voltage.

According to anther aspect of the present invention, for achieving the above object, there is provided a constant voltage circuit comprising a first transistor of a first conductive type having a drain connected to a power supply voltage and a source connected to the drain of the respective memory cells, a second transistor of a second conductive type having a source connected to the power supply voltage, a gate connected to a ground, and a drain connected to a gate of the first transistor, a third transistor of a first conductive type having a source connected to the ground, a gate connected to the source of the first transistor, and a drain connected to the gate of the first transistor, a fourth transistor of a first conductive type connecting in parallel with the first transistor, and a potential detecting circuit controlling the fourth transistor so as to turn on when an output potential voltage appeared on a common source of the first and second transistors is lower than the predetermined reference voltage, and controlling the fourth transistor so as to turn off when the output potential voltage is higher than the predetermined reference voltage.

According to another aspect of the present invention, for achieving the above object, there is provided a constant voltage circuit comprising a first transistor of a first conductive type having a drain connected to a power supply voltage and a source connected to the drain of the respective memory cells, a second transistor of a second conductive type having a source connected to the power supply voltage, a gate connected to a ground, and a drain connected to a gate of the first transistor, a third transistor of a first conductive type having a source connected to the ground, a gate connected to the source of the first transistor, and a drain connected to the gate of the first transistor, a fourth transistor of a second conductive type connecting in parallel with the second transistor, and a potential detecting circuit controlling the fourth transistor so as to turn on when an output potential voltage appeared on the source of the first transistor is lower than the predetermined reference voltage, and controlling the fourth transistor so as to turn off when the output potential voltage is higher than the predetermined reference voltage.

BRIEF DESCRIPTION OF THE DRAWINGS

While the specification concludes claims particularly pointing out and distinctly claiming the subject mater that is regarded as the invention, the invention, along with the objects, features, and advantages thereof, will be better understood from the following description taken in connection with the accompanying drawings, in which:

FIG. 3 is a table showing an operation of a constant voltage circuit according to a first preferred embodiment of a present invention.

DETAILED DESCRIPTION OF THE PREFERRED EMBODIMENTS

A semiconductor memory device according to the present invention will hereinafter be described in detail with reference to the accompanying drawings.

Figure 1:
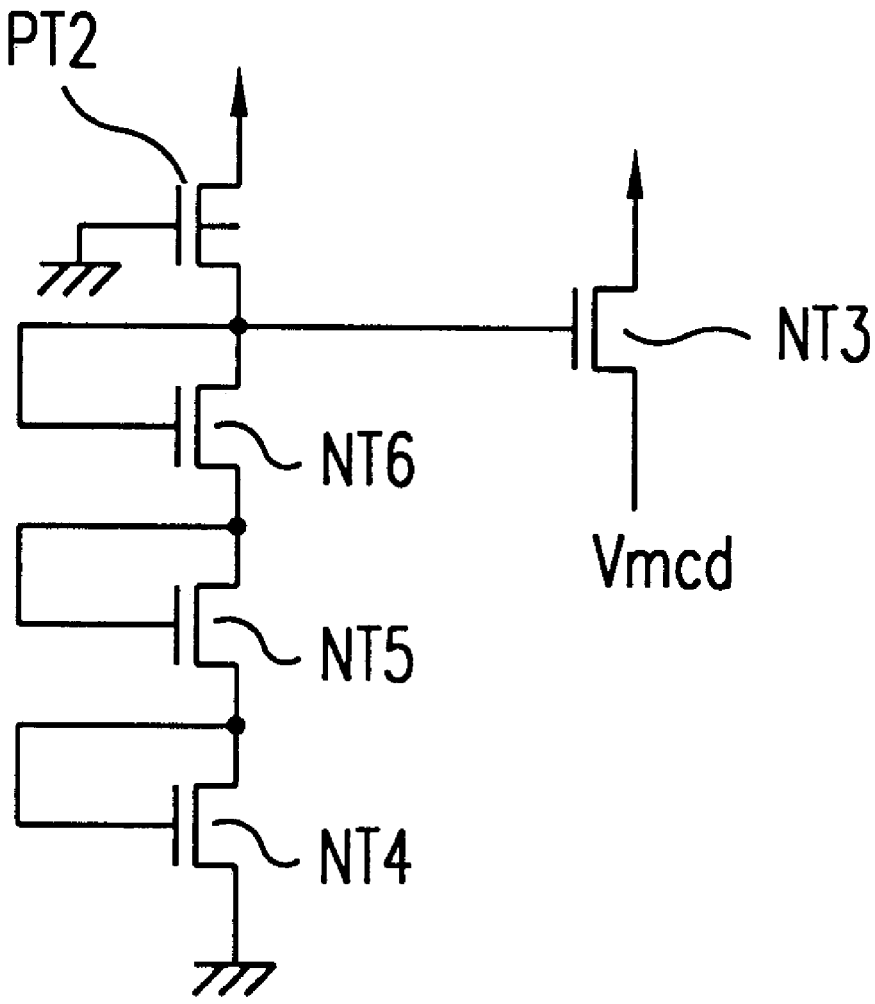
FIG. 1 is a schematic diagram showing a constant voltage circuit of a semiconductor memory device according to a first preferred embodiment of a present invention.
Figure 2:
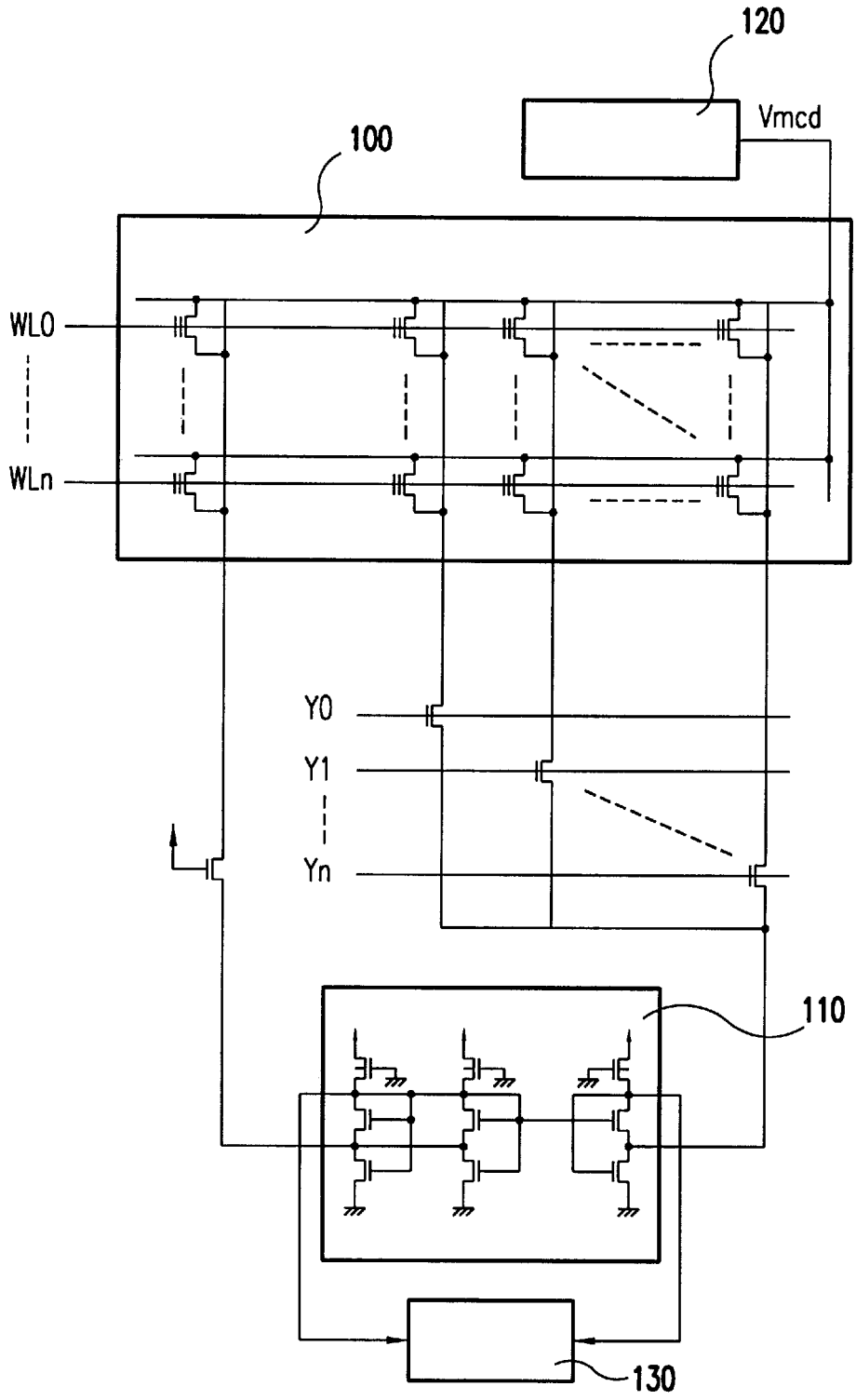
FIG.2 PRIOR ART
FIG. 2 is a circuit diagram for describing a data reading operation according to a conventional semiconductor memory device.

FIG. 1 is a schematic diagram showing a constant voltage circuit according to a first preferred embodiment of the present invention.

As shown in FIG. 1, a constant voltage circuit is preferably made up of an N-channel MOS transistor NT3 having a source connected to a drain of each memory cell (not shown) and a drain connected to a power supply voltage $V_{cc}$, a P-channel MOS transistor PT2 having a source connected to the power supply voltage $V_{cc}$ and a drain connected to a gate of the N-channel MOS transistor NT3 and a gate connected to a ground, and a reference voltage circuit formed by diode coupled-three stage N-channel MOS transistors NT4~NT6 connected as a load with the P-channel MOS transistor PT2. The constant voltage circuit generates an output voltage $V_{mcd}$, so as to apply the output voltage $V_{mcd}$ to the drains of each of the memory cells and so as to avoid application of excess voltages to the drains of each of the memory cells. Here, the P-channel MOS transistor PT2 and the N-channel MOS transistors NT3, NT4, NT5, and NT6 have the same threshold voltage Vth, for example the threshold voltage Vth of 0.6~0.8 V.

Figure 4:
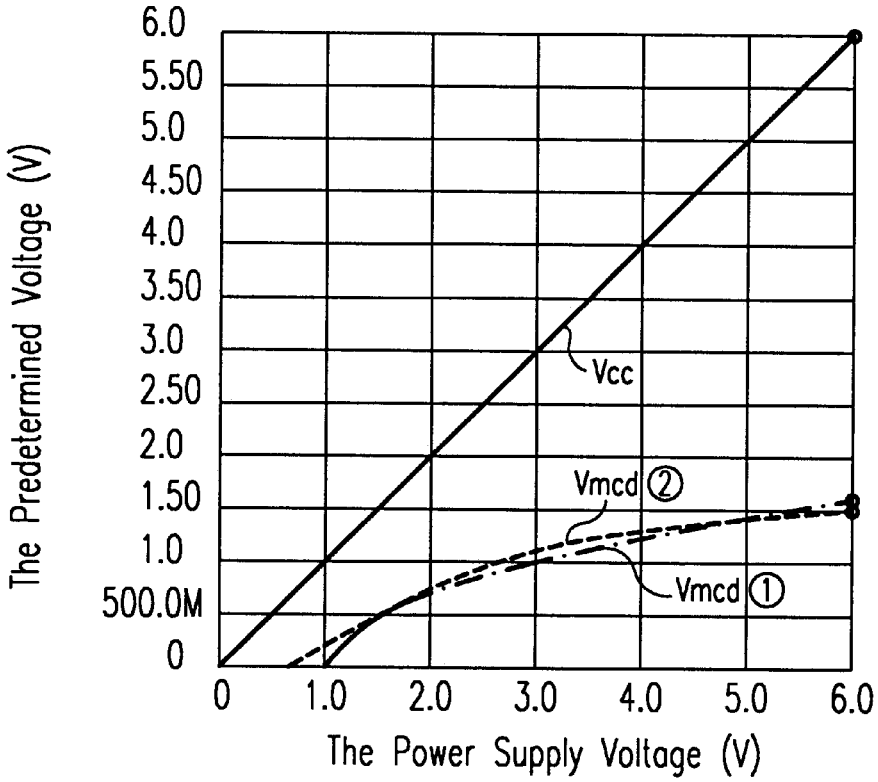
FIG. 4 is a diagram showing a power supply voltage characteristic of a constant voltage circuit according to a first preferred embodiment of a present invention.

FIG. 3 is a table showing an operation of the constant voltage circuit according to the first preferred embodiment of a present invention. FIG. 4 is a diagram showing a power supply voltage characteristic of the constant voltage circuit according to the first preferred embodiment of a present invention.

As shown in FIG. 3, when the power supply voltage $V_{cc}$ is less than a threshold voltage $V_{th}$, the MOS transistors NT3~NT6 don't turn on. As a result, an output of the constant voltage circuit is a high impedance. When the power supply voltage $V_{cc}$ is more than the threshold voltage $V_{th}$, the MOS transistor PT2 and the MOS transistor NT3 turn on. As a result, the output of the constant voltage circuit generates a $V_{cc}-V_{th}$ voltage as an output voltage $V_{mcd}$ of the constant voltage circuit. This operational state is maintained until the three stage N-channel MOS transistors NT4~NT6 receive a potential which is sufficient trigger their operation, that is, until the power supply voltage $V_{cc}$ becomes 3 $V_{th}$.

In the power supply voltage $V_{cc}$ characteristic of the conventional constant voltage circuit, the output voltage $V_{mcd}$ and the power supply voltage $V_{cc}$ have the same slope in the range from 2 $V_{th}$ to 3 $V_{th}$. Therefore, the first preferred embodiment can have the output voltage $V_{mcd}$ larger than the conventional constant voltage circuit in the range of 2 $V_{th} \leqq V_{cc} < 3\ V_{th}$. Further, the three stage N-channel MOS transistors NT4~NT6 turn on in the range of 3 $V_{th}$ or more.

Therefore, the gate of the MOS transistor NT3 is fix to 3 $V_{th}$ without depending a value of the power supply voltage $V_{cc}$. As a result, the output voltage $V_{mcd}$ is fix about 2 $V_{th}$ and can avoid the influence of the power supply $V_{cc}$. Therefore, when the power supply voltage $V_{cc}$ becomes 4.7 $V_{th}$, a value of the output voltage $V_{mcd}$ becomes in the saturation state.

As the mentioned above, the first preferred embodiment can apply a high voltage for the output voltage $V_{mcd}$ to drains of each of memory cells in the range of 2 $V_{th} \leqq V_{cc} < 4.7\ V_{th}$. Therefore, the first preferred embodiment can apply a high voltage for the output voltage $V_{mcd}$ to drains of each of memory cells even if the power supply voltage $V_{cc}$ is a low voltage and further can achieve the improvement of the access velocity for the data reading operation of the semiconductor memory device.

Figure 5:
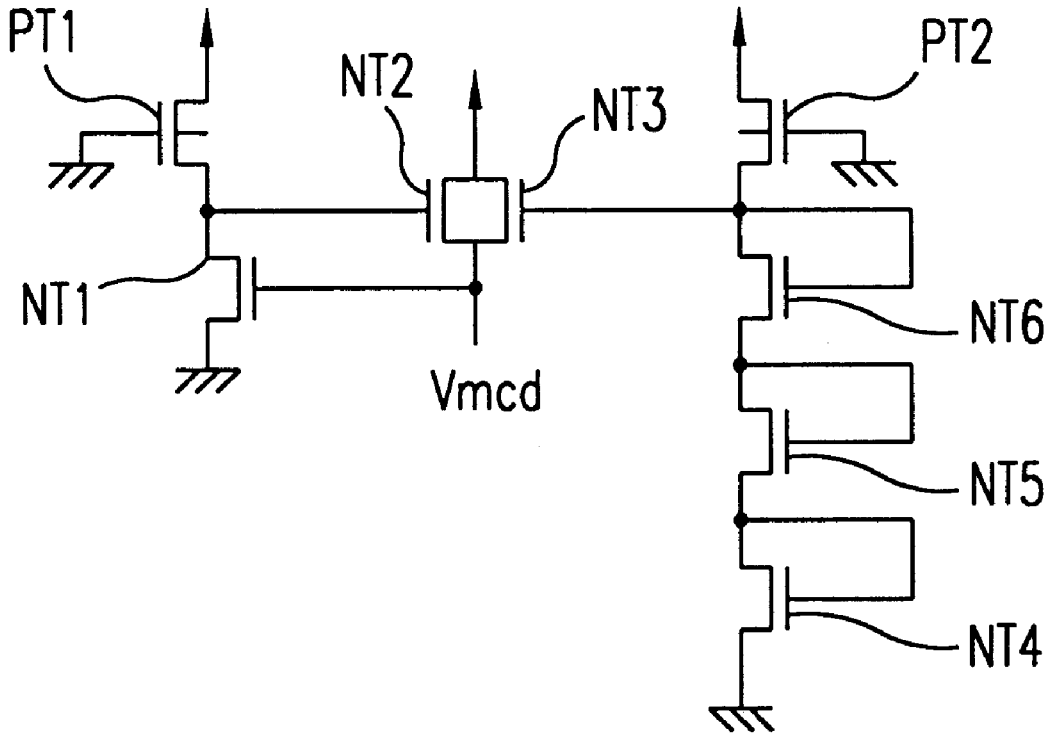
FIG. 5 is a schematic diagram showing a constant voltage circuit of a semiconductor memory device according to a second preferred embodiment of a present invention.

FIG. 5 is a schematic diagram showing a constant voltage circuit of a semiconductor memory device according to a second preferred embodiment of a present invention.

As shown in FIG. 5, a first constant voltage circuit is preferably made up of an N-channel MOS transistor NT3 connected a drain of each of memory cells (not shown) with a source thereof and connected a power supply voltage $V_{cc}$ with a drain thereof, a P-channel MOS transistor PT2 connected the power supply voltage $V_{cc}$ with a source thereof and connected a gate of the N-channel MOS transistor NT3 with a drain, and a reference voltage generated circuit having some diode coupled-three stage N-channel MOS transistors NT4~NT6 connected with the P-channel MOS transistor PT2 as a load. A second constant voltage circuit is preferably made up of a N-channel MOS transistor NT2 connected a drain of each of memory cells with a source thereof, connected a power supply voltage $V_{cc}$ with a drain thereof, and respectively connected the source and drain of the N-channel MOS transistor NT3 with source and drain thereof, a P-channel MOS transistor PT1 connected the power supply voltage $V_{cc}$ with a source thereof, connected a ground with a gate thereof, and connected a gate of the N-channel MOS transistor NT2 with a drain thereof, an N=channel MOS transistor NT1 connected a ground with a source thereof, connected the drain of each of memory cells with a gate thereof. The second preferred embodiment is constructed so as to apply a higher output voltage $V_{mcd}$ to the drain of each of memory cells when comparing output voltages $V_{mcd}$ of first and second constant voltage circuits. Here, the P-channel MOS transistors PT1 and PT2 and the N-channel MOS transistors NT1, NT2, NT3, NT4, NT5, and NT6 have the same threshold voltage Vth, for example the threshold voltage Vth of 0.6~0.8 V.

Figure 6:
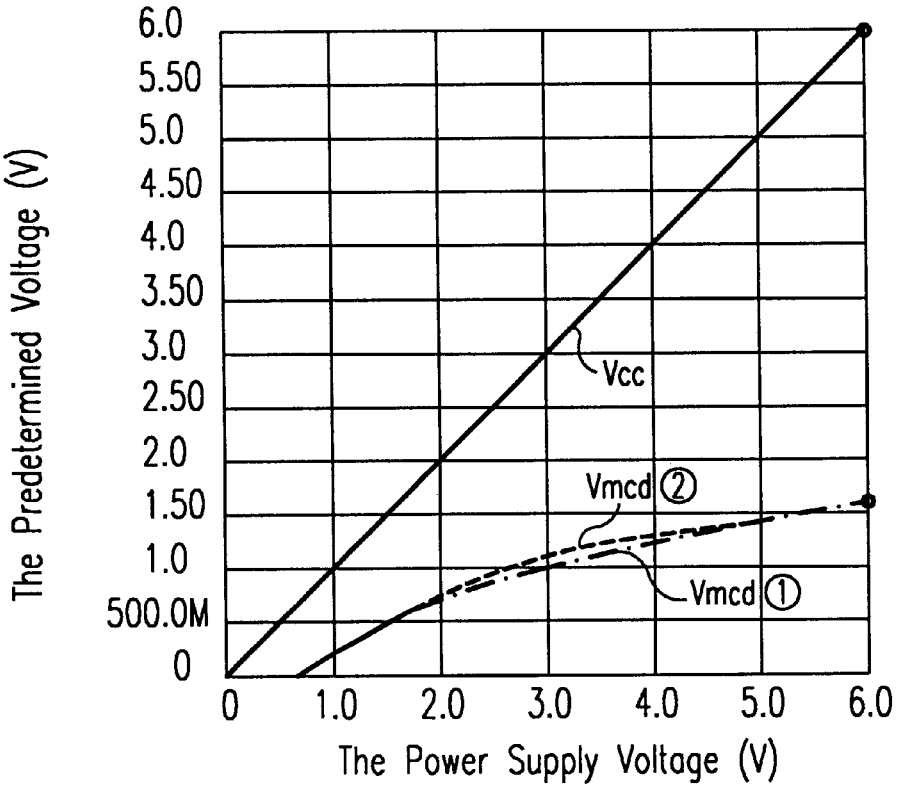
FIG. 6 is a diagram showing a power supply voltage characteristic of a constant voltage circuit according to a second preferred embodiment of a present invention.

FIG. 6 is a diagram showing a power supply voltage characteristics of a constant voltage circuit according to a second preferred embodiment of a present invention.

As shown in FIG. 6, the second preferred embodiment applies the output voltage $V_{mcd}$ of the first constant voltage circuit to the drain of each of memory cells in the range of 2 $V_{th} \leqq V_{cc} < 4.7\ V_{th}$, and applies the output voltage $V_{mcd}$ of the second constant voltage circuit to the drain of each of memory cells in the other range.

Accordingly, the second preferred embodiment can apply a high voltage for the output voltage $V_{mcd}$ to drains of each of memory cells even if the power supply voltage $V_{cc}$ is a low voltage and further can achieve the improvement of the access velocity for the data reading operation of the semiconductor memory device. Further, since the second preferred embodiment is constructed so as to apply a higher output voltage $V_{mcd}$ to the drain of each of memory cells when comparing output voltages $V_{mcd}$ of first and second constant voltage circuits, the second preferred embodiment could be avoided to rapidly change the output voltages $V_{mcd}$ because of potential changes at a low power supply.

Figure 7:
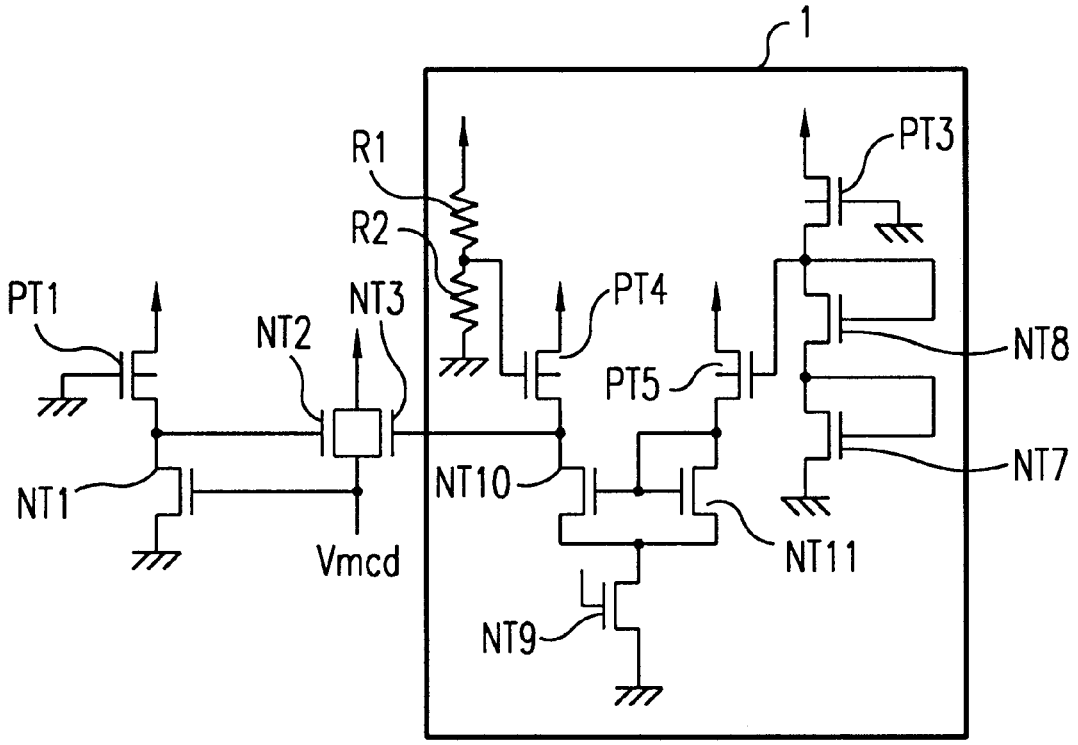
FIG. 7 is a schematic diagram showing a constant voltage circuit of a semiconductor memory device according to a third preferred embodiment of a present invention.

FIG. 7 is a schematic diagram showing a constant voltage circuit of a semiconductor memory device according to a third preferred embodiment of a present invention.

A third preferred embodiment has circuitry combined the first constant voltage circuit of the second preferred embodiment and a $V_{cc}$ potential detecting circuit 1.

The $V_{cc}$ potential detecting circuit 1 detects whether a power supply voltage $V_{cc}$ exceeds a predetermined reference voltage or not, outputs an L level (a ground potential) after exceeding the reference voltage, and outputs an H level (the power supply voltage $V_{cc}$) before exceeding the reference voltage. Here, the predetermined reference voltage is 2 $V_{th} \times (r1+r2)/r2$.(r1: a resistivity of the resistor R1, r2: a resistivity of the resistor R2)

The $V_{cc}$ potential detecting circuit 1 includes a circuitry for generating differential inputs and a differential amplifier. The $V_{cc}$ potential detecting circuit 1 is preferably made up of a differential pair of the MOS transistors PT4 and PT5, plural resistors R1 and R2 connected with a gate of the MOS transistor PT4, and a plurality of the diode coupled MOS transistors NT7 and NT8 connected with a gate of the MOS transistor PT5, and the MOS transistor PT4 is connected with a gate of the MOS transistor NT3. The differential amplifier outputs the H level (the power supply voltage $V_{cc}$) of the L level (the ground potential) in response to the differential inputs and which has P-channel MOS transistors PT3 and PT4 and N-channel MOS transistors NT9~NT11. Here, the P-channel MOS transistors PT1, PT3, PT4, and PT5 and the N-channel MOS transistors NT1, NT2, NT3, NT7, NT8, NT9, NT10 and NT11 have the same threshold voltage Vth, for example the threshold voltage Vth of 0.6~0.8 V.

Figure 8:
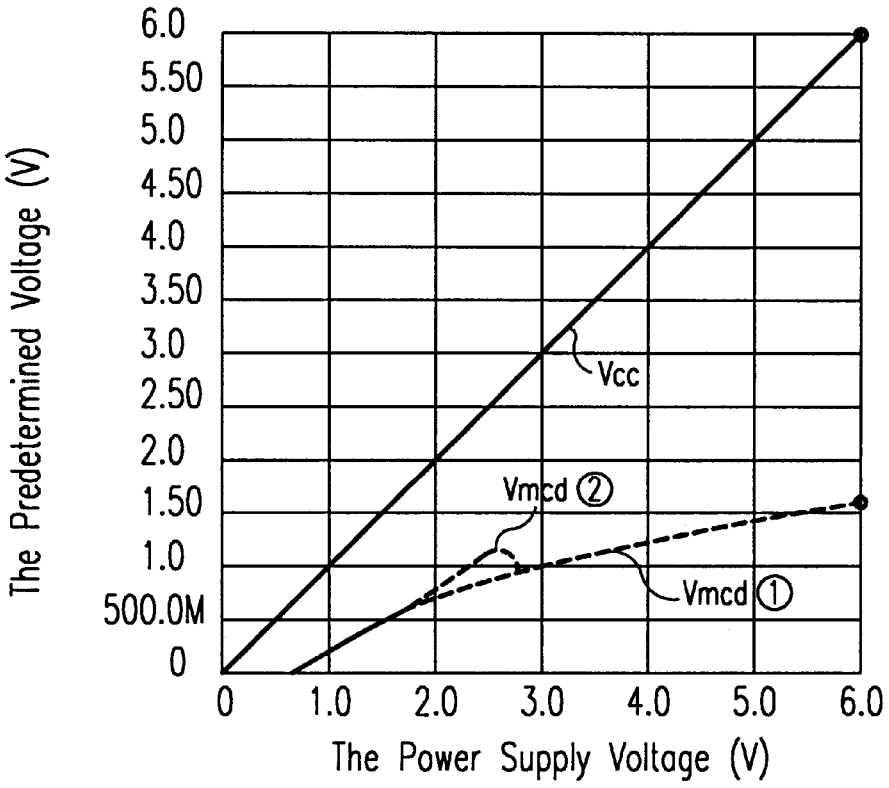
FIG. 8 is a diagram showing a power supply voltage characteristic of a constant voltage circuit according to a third preferred embodiment of a present invention.

FIG. 8 is a diagram showing a power supply voltage characteristic of a constant voltage circuit according to a third preferred embodiment of a present invention.

As shown in FIG. 8, in the range that the power supply voltage $V_{cc}$ is a threshold voltage $v_{th}$ or less, all MOS transistors NT1~NT3, NT7~NT11, PT1, and PT3~PT5 don't turn on. As a result, an output of the constant voltage circuit is a high impedance. When the power supply voltage $V_{cc}$ is then more than the threshold voltage $V_{th}$, the MOS transistors PT1, PT3, and NT2 turn on. As a result, a $V_{cc}-V_{th}$ voltage as an output voltage $V_{mcd}$ of the constant voltage circuit appears on the source of the MOS transistor NT2. On the other hand, the power supply voltage $V_{cc}$ is applied to the gate of the MOS transistor PT5 from the MOS transistor PT3. However, since the gate of the MOS transistor PT5 and the source of the MOS transistor NT2 have the same potential, the MOS transistor PT5 and NT2 maintain an OFF state. As a result, the MOS transistor NT10 and NT11 also maintain an OFF state. Next, since a voltage divided the power supply voltage $V_{cc}$ applies to the drain of the MOS transistor PT3, the MOS transistor PT3 turns on when a potential difference becomes higher than a threshold voltage $V_{th}$. As a result, outputs of the $V_{cc}$ potential detecting circuit 1 becomes an H level ($V_{cc}$) and a $V_{cc}-V_{th}$ voltage appears on the source of the MOS transistor NT3. Therefore, $V_{cc}-V_{th}$ voltage as an output voltage $V_{mcd}$ is applied from the constant voltage circuit to drains of each memory cells in the range of 2 $V_{th} \leqq$ the power supply voltage $V_{cc}$ < the reference voltage. This means, in the conventional semiconductor memory device, the output voltage $V_{mcd}$ ha an alternation slope lower than the power supply voltage $V_{cc}$ at 2 $V_{th}$ when an alternation slope of the power supply voltage $V_{cc}$ compares with that of the output voltage $V_{mcd}$. The third preferred embodiment can generate higher output voltage $V_{mcd}$ than the conventional semiconductor memory device in the range of 2 $V_{th}$≦the power supply voltage $V_{cc}$<the reference voltage. Then, the MOS transistor PT4 turns off and the MOS transistor PT5 turns on when the power supply voltage $V_{cc}$ is higher than the reference voltage. As a result, the MOS transistors NT10 and NT11 turn on and the output of the $V_{cc}$ potential detecting circuit 1 becomes a L level (the ground potential). That is, the output voltage $V_{mcd}$ change from $V_{cc}-V_{th}$ to $V_g-V_{th}$ when the power supply voltage $V_{cc}$ is higher than the reference voltage.

As the mentioned above, the third preferred embodiment can apply to the drains of each memory cells higher drain potentials than the conventional semiconductor memory device in the low power supply voltage $V_{cc}$ and which can apply to the drains of each memory cells the same drain potentials as the conventional semiconductor memory device in the high power supply voltage $V_{cc}$.

The third preferred embodiment uses the diode coupled-twice stage MOS transistors, but it may be used some diode coupled-third and more stage MOS transistors.

Figure 9:
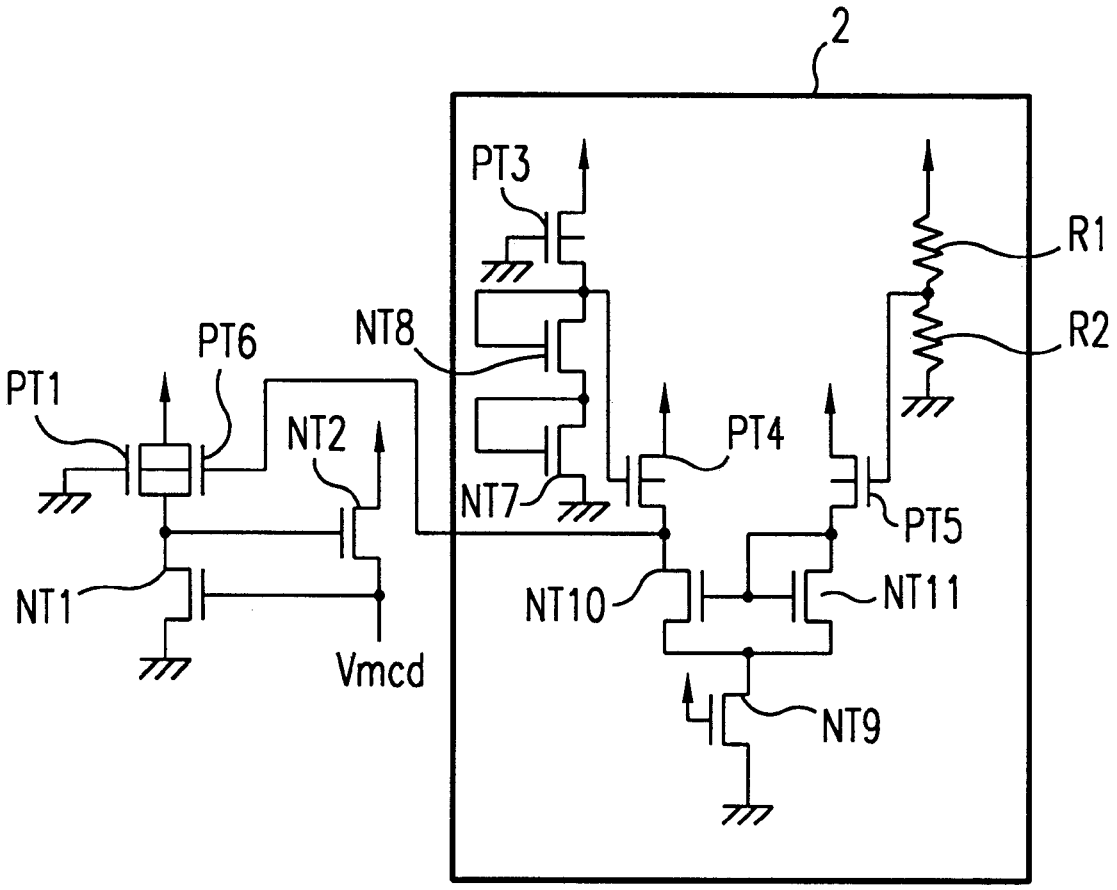
FIG. 9 is a schematic diagram showing a constant voltage circuit of a semiconductor memory device according to a fourth preferred embodiment of a present invention.

FIG. 9 is a schematic diagram showing a constant voltage circuit of a semiconductor memory device according to a fourth preferred embodiment of a present invention.

As shown in FIG. 9, the fourth preferred embodiment is the same as the third preferred embodiment in having the circuitry combined the first constant voltage circuit of the second preferred embodiment and a $V_{cc}$ potential detecting circuit of the third preferred embodiment. However, the fourth preferred embodiment is different from the third preferred embodiment in using outputs of the $V_{cc}$ potential detecting circuit in order to drive a P-channel MOS transistor PT6 connected to a P-channel MOS transistor PT1, in parallel, which determines gate potentials $V_g$ of an N-channel MOS transistor NT2. Therefore, by maintaining the gate potentials $V_g$ of an N-channel MOS transistor NT2 in low power supply voltage $V_{cc}$, a constant voltage circuit of the fourth preferred embodiment sets so as to be high output voltages $V_{mcd}$ applied to drains of each memory cells. Thus, the $V_{cc}$ potential detecting circuit 2 is preferably made up of a differential pair of the MOS transistors PT4 and PT5, plural resistors R1 and R2 connected with a gate of the MOS transistor PT5, and a plurality of diode coupled MOS transistors NT7 and NT8 connected with a gate of the MOS transistor PT4, and the MOS transistor PT4 is connected with a gate of the MOS transistor PT6. The $V_{cc}$ potential detecting circuit 2 has the circuitry so as to apply potentials divided the power supply voltage $V_{cc}$ by the resistors R1 and R2 to a gate of the P-channel MOS transistor PT5, and to apply potentials generated from the series circuit to a gate of the P-channel MOS transistor PT4.

Figure 10:
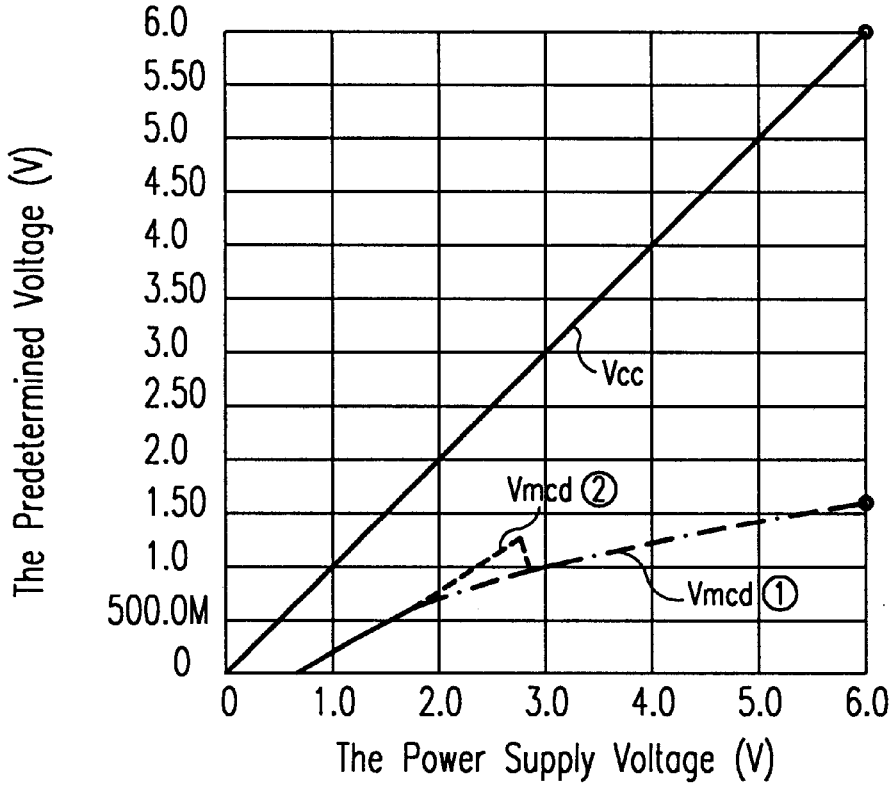
FIG. 10 is a diagram showing a power supply voltage characteristic of a constant voltage circuit according to a fourth preferred embodiment of a present invention.

Here, the P-channel MOS transistors PT1, PT3, PT4, PT5, and PT6 and the N-channel MOS transistors NT1, NT2, NT7, NT8, NT9, NT10 and NT11 have the same threshold voltage Vth, for example the threshold voltage Vth of 0.6~0.8 V. FIG. 10 is a diagram showing a power supply voltage characteristic of a constant voltage circuit according to a fourth preferred embodiment of a present invention.

As shown in FIG. 10, in the range that the power supply voltage $V_{cc}$ is a threshold voltage $V_{th}$ or less, each MOS transistors don't turn on. As a result, an output of the constant voltage circuit is a high impedance. When the power supply voltage $V_{cc}$ is then more than the threshold voltage $V_{th}$, the MOS transistors PT1, PT3, and NT2 turn on. As a result, in the range that the power supply voltage $V_{cc}$ is a threshold voltage $V_{th}$ or less, a $V_{cc}-V_{th}$ ($V_{cc}$: potentials appeared on a drain of the MOS transistor PT1, $V_{th}$: a threshold voltage of the MOS transistor NT2) as an output voltage $V_{mcd}$ of the constant voltage circuit is outputted.

When the power supply voltage $V_{cc}$ rises and it is more than 2 $V_{th}$, the MOS transistor NT1 turns on and a gate potential of the MOS transistor NT2 pulls down from the power supply voltage $V_{cc}$. However, since the MOS transistor NT2 is supplied the power supply voltage $V_{cc}$ by both of the MOS transistors PT1 and PT6, the gate potential of the MOS transistor NT2 is higher than the conventional constant voltage circuit. As a result, the output voltage $V_{mcd}$ ($V_g-V_{th}$) higher than the conventional constant voltage circuit is capable of outputting from an output terminal of the MOS transistor NT2.

Then, when the power supply voltage $V_{cc}$ is more than the predetermined reference voltage, the MOS transistors PT4 turns on and outputs of the $V_{cc}$ potential detecting circuit 2 switches from L level (the ground potential) to H level. As a result, the MOS transistor PT1 and the MOS transistor PT6 supplied the gate potential $V_g$ to the MOS transistor NT2, which turn off. Accordingly, the gate potential $V_g$ becomes so as to determine by only the MOS transistors NT1, NT2, PT1, and PT6.

As the mentioned above, the fourth preferred embodiment can apply to the drains of each memory cells higher drain potentials than the conventional semiconductor memory device in the low power supply voltage $V_{cc}$ and which can apply to the drains of each memory cells the same drain potentials as the conventional semiconductor memory device in the high power supply voltage $V_{cc}$.

The fourth preferred embodiment uses the diode coupled-twice stage MOS transistors, but it may be used a diode coupled-third and more stage MOS transistors.

Figure 11:
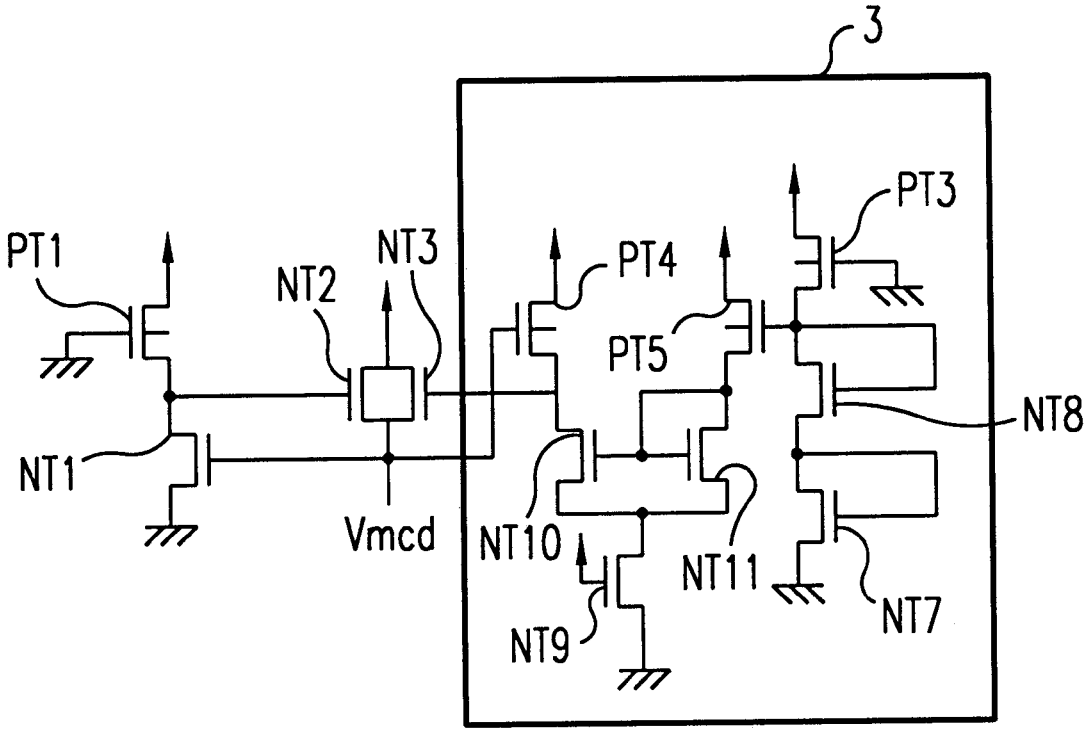
FIG. 11 is a schematic diagram showing a constant voltage circuit of a semiconductor memory device according to a fifth preferred embodiment of a present invention.

FIG. 11 is a schematic diagram showing a constant voltage circuit of a semiconductor memory device according to a fifth preferred embodiment of a present invention.

A fifth preferred embodiment is modified embodiment of the third preferred embodiment.

In the fifth preferred embodiment, a MOS transistor NT3 connected with a MOS transistor NT2 supplying a output voltage $V_{mcd}$ in parallel, which is turned on in the low power supply voltage $V_{cc}$. As a result, the fifth preferred embodiment can achieve a high voltage for the output voltage $V_{mcd}$.

The fifth preferred embodiment controls the output voltage $V_{mcd}$ based on whether the output voltage $V_{mcd}$ is more than the predetermined reference voltage. Therefore, by detecting the output voltage $V_{mcd}$ in a $V_{mcd}$ detecting circuit 3, the output voltage $V_{mcd}$ is controlled in response to the detected result. Thus, the $V_{mcd}$ detecting circuit 3 is constructed so as to apply the output voltage $V_{mcd}$ to a gate of the MOS transistor NT4 constructing a differential pair. Therefore, the $V_{mcd}$ detecting circuit 3 is made up of a differential pair of the MOS transistors PT4 and PT5, and a plurality of diode coupled MOS transistors NT7 and NT8 connected with a gate of the MOS transistor PT5, and a gate of the MOS transistor PT4 is connected with the drain of the respective memory cells. As a result, the $V_{mcd}$ detecting circuit 3 operates so as to maintain a H level ($V_{cc}$) outputs of the $V_{mcd}$ detecting circuit 3 until detecting the $V_{mcd}$ detecting circuit 3 in which the output voltage $V_{mcd}$ is actually more than 2 $V_{th}$. Thus, in the range that the output voltage $V_{mcd}$ is more than 2 $V_{th}$, the outputs of the $V_{mcd}$ detecting circuit 3 switch to a L level (the ground potential) and potentials of the output voltage $V_{mcd}$ switches to $V_g-V_{th}$ applied from MOS transistors PT1, NT1, NT2, and NT3. Here, potential differences don't cause in before and after of the switching operation for $V_g$–$V_{th}$.

Here, the P-channel MOS transistors PT1, PT3, PT4, and PT5 and the N-channel MOS transistors NT1, NT2, NT3, NT7, NT8, NT9, NT10 and NT11 have the same threshold voltage Vth, for example the threshold voltage Vth of 0.6~0.8 V.

Figure 12:
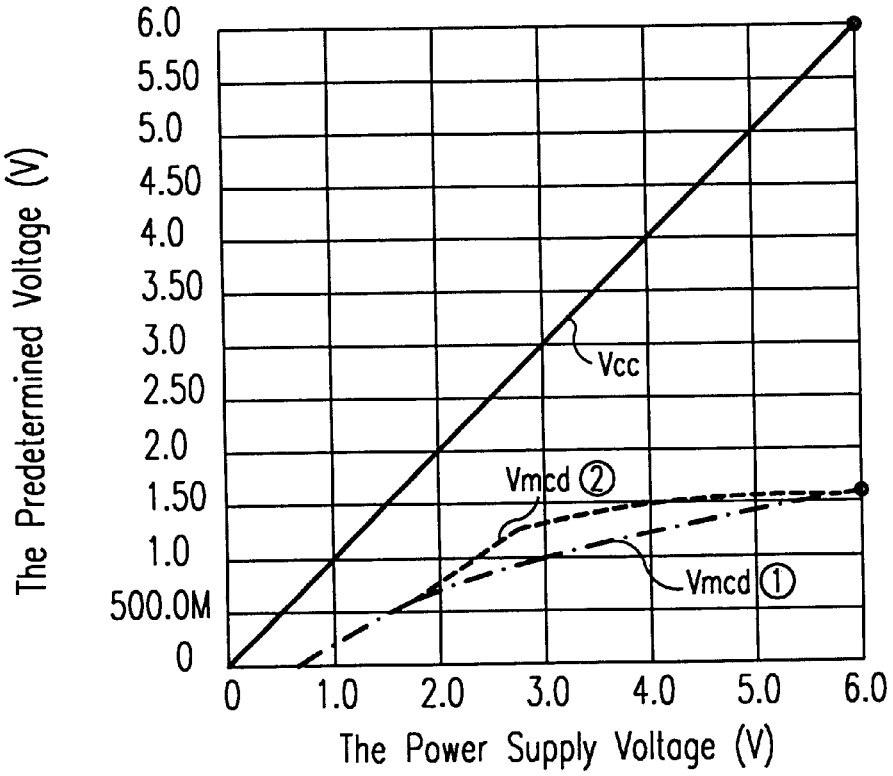
FIG. 12 is a diagram showing a power supply voltage characteristic of a constant voltage circuit according to a fifth preferred embodiment of a present invention.

As mentioned above, the fifth preferred embodiment can apply to the drains of each memory cells higher drain potentials than the conventional semiconductor memory device in the low power supply voltage $V_{cc}$ and which can apply to the drains of each memory cells the same drain potentials as the conventional semiconductor memory device in the high power supply voltage $V_{cc}$. FIG. 12 is a diagram showing a power supply voltage characteristic of a constant voltage circuit according to a fifth preferred embodiment of a present invention. As shown in FIG. 12, by detecting the output voltage $V_{mcd}$ in a $V_{mcd}$ detecting circuit 3, the output voltage $V_{mcd}$ is controlled in response to the detected result. Accordingly, the fifth preferred embodiment can avoid to appear discontinuous action points and can efficiently avoid the circumstances that characteristic of the constant voltage circuit rapidly changes as a borderline between specific potentials.

Figure 13:
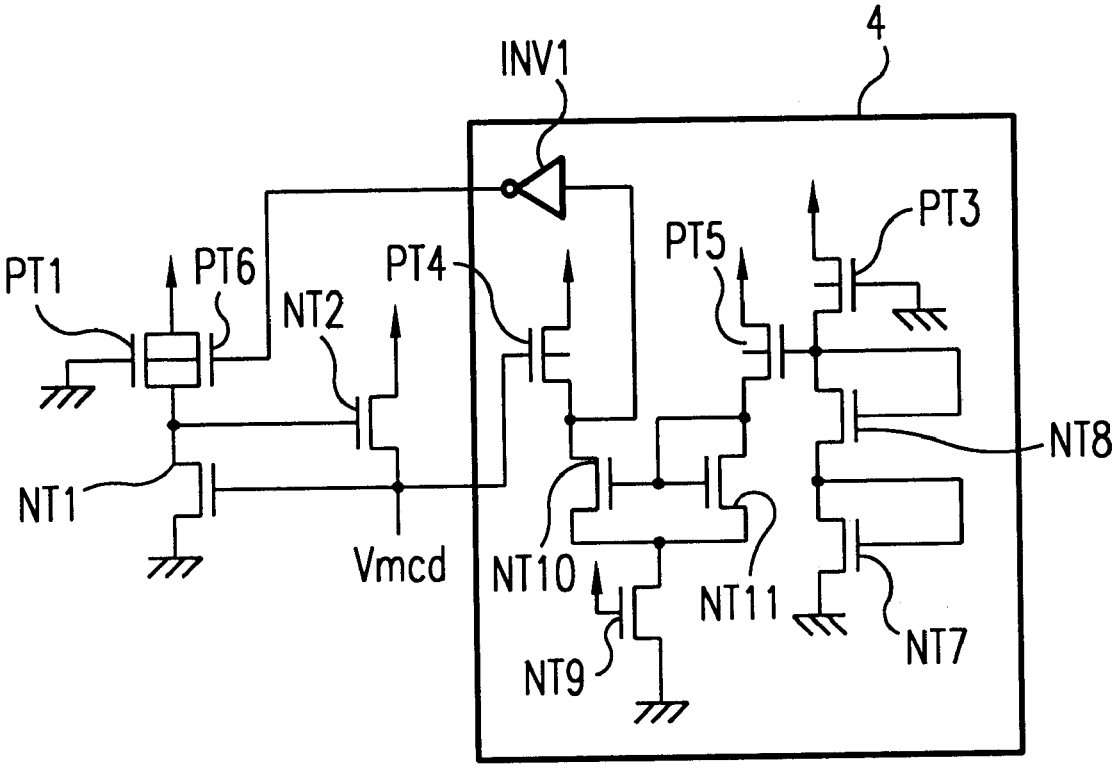
FIG. 13 is a schematic diagram showing a constant voltage circuit of a semiconductor memory device according to a sixth preferred embodiment of a present invention.
Figure 14:
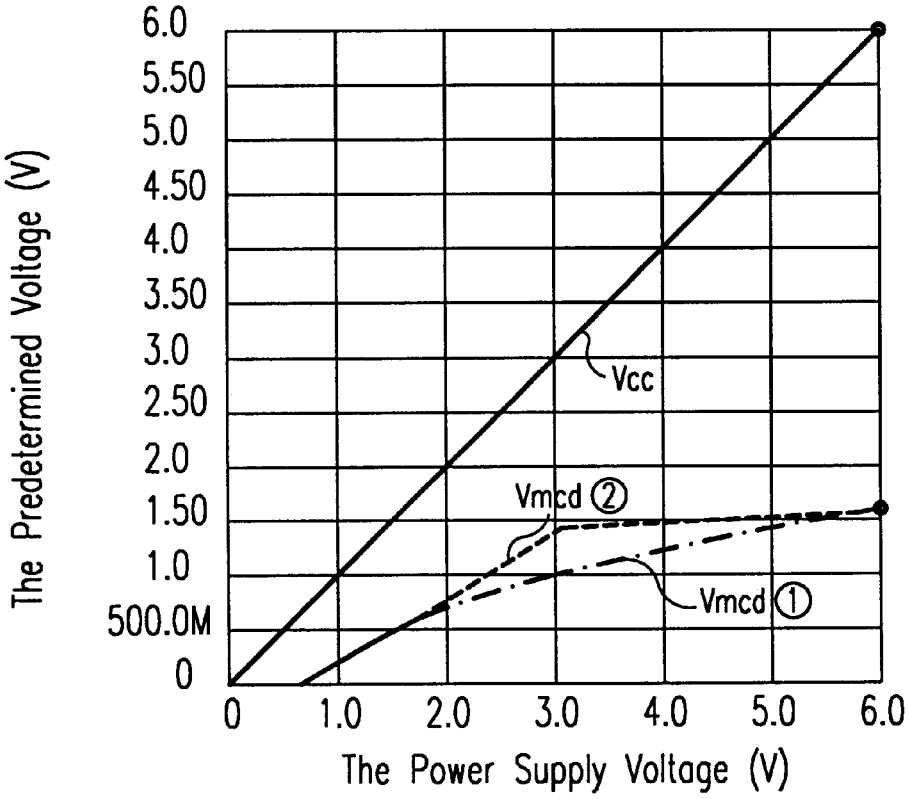
FIG. 14 is a diagram showing a power supply voltage characteristic of a constant voltage circuit according to a sixth preferred embodiment of a present invention.

FIG. 13 is a schematic diagram showing a constant voltage circuit of a semiconductor memory device according to a sixth preferred embodiment of a present invention.

A sixth preferred embodiment is modified embodiment of the fourth preferred embodiment.

The sixth preferred embodiment pulls up a gate potential $V_g$ of a MOS transistor NT2 by turning on in the range of the low power supply voltage a MOS transistor PT6 connected with a MOS transistor PT1 in parallel. In the sixth preferred embodiment, by detecting the output voltage $V_{mcd}$ in a $V_{mcd}$ detecting circuit 4, the MOS transistor PT6 is controlled in response to the detected result. The $V_{mcd}$ detecting circuit 4 is constructed so as to apply outputs of a MOS transistor PT4 to a gate of a MOS transistor PT6 through an inverter INV1. Therefore, the $V_{mcd}$ detecting circuit 4 is made up of a differential pair of the MOS transistors PT4 and PT5, a plurality of diode coupled MOS transistors NT7 and NT8 connected with a gate of the MOS transistor PT5, and a inverter INV1 connected between a gate of the MOS transistor PT6 and the MOS transistor PT4, and a gate of the MOS transistor PT4 is connected with the drain of the respective memory cells. As a result, the $V_{mcd}$ detecting circuit 4 operates so as to maintain a L level (the ground potential) outputs of the $V_{mcd}$ detecting circuit 4 until detecting the $V_{mcd}$ detecting circuit 4 in which the output voltage $V_{mcd}$ is actually more than 2 $V_{th}$. Thus, in the range that the output voltage $V_{mcd}$ is more than 2 $V_{th}$, the outputs of the $V_{mcd}$ detecting circuit 4 switch to a H level ($V_{cc}$) and potentials of the output voltage $V_{mcd}$ switches to $V_g$–$V_{th}$ applied from MOS transistors PT1, PT6, NT1, and NT2. Here, potential differences don't cause in before and after of the switching operation for $V_g$–$V_{th}$.

Here, the P-channel MOS transistors PT1, PT3, PT4, PT5, and PT6 and the N-channel MOS transistors NT1, NT2, NT7, NT8, NT9, NT10 and NT11 have the same threshold voltage Vth, for example the threshold voltage Vth of 0.6~0.8 V.

As the mentioned above, the sixth preferred embodiment can apply to the drains of each memory cells higher drain potentials than the conventional semiconductor memory device in the high power supply voltage $V_{cc}$. FIG. 13 is a diagram showing a power supply voltage characteristic of a constant voltage circuit according to a sixth preferred embodiment of a present invention. As shown in FIG. 13, by detecting the output voltage $V_{mcd}$ in a $V_{mcd}$ detecting circuit 4, the MOS transistor PT6 is controlled in response to the detected result. Accordingly, the sixth preferred embodiment can avoid to appear discontinuous action points and can efficiently avoid the circumstances that characteristic of the constant voltage circuit rapidly changes as a borderline between specific potentials.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A constant voltage circuit comprising:

a first constant voltage circuit having a first transistor of a first conductive type, a second transistor of a second conductive type, and a third transistor of the first conductive type;

the first transistor having a first main electrode connected to a power supply voltage and a second main electrode connected to an output terminal;

the second transistor having a second main electrode connected to the power supply voltage, a gate connected to a ground, and a first main electrode connected to a gate of the first transistor;

the third transistor having a second main electrode connected to the ground, a gate connected to the second main electrode of the first transistor, and a first main electrode type connected to the gate of the first transistor;

a second constant voltage circuit having a fourth transistor of the first conductive type and a reference voltage generating circuit;

the fourth transistor connected in parallel with the first transistor; and the reference voltage generating circuit controlling the fourth transistor so as to turn on when a power supply voltage is lower than a predetermined reference voltage, and which controls the fourth transistor so as to turn off when the power supply voltage is higher than the predetermined reference voltage.

2. A constant voltage circuit as claimed in claim 1, wherein the reference voltage generating circuit comprises a plurality of diode coupled transistors.

3. A constant voltage circuit as claimed in claim 1, wherein the first conductive type is an N-channel type, the second conductive type is a P-channel type, the first main electrode is a drain, and the second main electrode is a source.

4. A constant voltage circuit as claimed in claim 1, wherein the output terminal connects to respective memory cells.

5. A constant voltage circuit comprising:

a first transistor of a first conductive type having a first main electrode connected to a power supply voltage and a second main electrode connected to an output terminal;

a second transistor of a second conductive type having a second main electrode connected to the power supply voltage, a gate connected to a ground, and a first main electrode connected to a gate of the first transistor;

a third transistor of the first conductive type having a second main electrode connected to the ground, a gate connected to the second main electrode of the first transistor, and a first main electrode connected to the gate of the first transistor;

a fourth transistor of the first conductive type connected in parallel with the first transistor; and a potential detecting circuit which controls the fourth transistor so as to turn on when a power supply voltage is lower than a predetermined reference voltage, and which controls the fourth transistor so as to turn off when the power supply voltage is higher than the predetermined reference voltage.

6. A constant voltage circuit as claimed in claim 5, wherein the potential detecting circuit comprises a differential pair of fifth and sixth transistors, plural resistors connected with a gate of the fifth transistor, and a plurality of diode coupled transistors connected with a gate of the sixth transistor, and wherein the fifth transistor is connected to a gate of the fourth transistor.

7. A constant voltage circuit as claimed in claim 5, wherein the first conductive type is an N-channel type, the second conductive type is a P-channel type, the first main electrode is a drain, and the second main electrode is a source.

8. A constant voltage circuit as claimed in claim 5, wherein the output terminal connects to respective memory cells.

9. A constant voltage circuit comprising:

a first transistor of a first conductive type having a first main electrode connected to a power supply voltage and a second main electrode connected to an output terminal;

a second transistor of a second conductive type having a second main electrode connected to the power supply voltage, a gate connected to a ground, and a first main electrode connected to a gate of the first transistor;

a third transistor of the first conductive type having a second main electrode connected to the ground, a gate connected to the second main electrode of the first transistor, and a first main electrode connected to the gate of the first transistor;

a fourth transistor of the second conductive type connected in parallel with the second transistor; and a potential detecting circuit which controls the fourth transistor so as to turn on when a power supply voltage is lower than a predetermined reference voltage, and which controls the fourth transistor so as to turn off when the power supply voltage is higher than the predetermined reference voltage.

10. A constant voltage circuit as claimed in claim 9, wherein the potential detecting circuit comprises a differential pair of fifth and sixth transistors, plural resistors connected with a gate of the fifth transistor, and a plurality of diode coupled transistors connected with a gate of the sixth transistor, and wherein the sixth transistor is connected to a gate of the fourth transistor.

11. A constant voltage circuit as claimed in claim 9, wherein the first conductive type is an N-channel type, the second conductive type is a P-channel type, the first main electrode is a drain, and the second main electrode is a source.

12. A constant voltage circuit as claimed in claim 9, wherein the output terminal connected to respective memory cells.

13. A constant voltage circuit comprising:

a first transistor of a first conductive type having a first main electrode connected to a power supply voltage and a second main electrode connected to an output terminal;

a second transistor of a second conductive type having a second main electrode connected to the power supply voltage, a gate connected to a ground, and a first main electrode connected to a gate of the first transistor;

a third transistor of the first conductive type having a second main electrode connected to the ground, a gate connected to the second main electrode of the first transistor, and a first main electrode type connected to the gate of the first transistor;

a fourth transistor of the first conductive type in parallel with the first transistor; and a potential detecting circuit which controls the fourth transistor so as to turn on when an output potential voltage appearing on a source of the first transistor is lower than a predetermined reference voltage, and which controls the fourth transistor so as to turn off when the output potential voltage is higher than the predetermined reference voltage.

14. A constant voltage circuit as claimed in claim 13, wherein the potential detecting circuit comprises a differential pair of fifth and sixth transistors and a plurality of diode coupled transistors connected with a gate of the sixth transistor, and wherein a gate of the fifth transistor is connected to the output terminal.

15. A constant voltage circuit as claimed in claim 13, wherein the first conductive type is an N-channel type, the second conductive type is a P-channel type, the first main electrode is a drain, and the second main electrode is a source.

16. A constant voltage circuit as claimed in claim 13, wherein the output terminal connects to respective memory cells.

17. A constant voltage circuit comprising:

a first transistor of a first conductive type having a first main electrode connected to a power supply voltage and a second main electrode connected to an output terminal;

a second transistor of a second conductive type having a second main electrode connected to the power supply voltage, a gate connected to a ground, and a first main electrode connected to a gate of the first transistor;

a third transistor of the first conductive type having a second main electrode connected to the ground, a gate connected to the second main electrode of the first transistor, and a first main electrode connected to the gate of the first transistor;

a fourth transistor of the second conductive type connected in parallel with the second transistor; and a potential detecting circuit which controls the fourth transistor so as to turn on when an output potential voltage appeared on the source of the first transistor is lower than a predetermined reference voltage, and which controls the fourth transistor so as to turn off when the output potential voltage is higher than the predetermined reference voltage.

18. A constant voltage circuit as claimed in claim 17, wherein the potential detecting circuit comprises a differential pair of fifth and sixth transistors, a plurality of diode coupled transistors connected with a gate of the sixth transistor, and a gate of the fifth transistor connects with the output terminal.

19. A constant voltage circuit as claimed in claim 17, wherein the first conductive type is an N-channel type, the second conductive type is a P-channel type, the first main electrode is a drain, and the second main electrode is a source.

20. A constant voltage circuit as claimed in claim 17, wherein the output terminal connects to respective memory cells.

* * * * *